US008106870B2

(12) United States Patent
Huang

(10) Patent No.: US 8,106,870 B2
(45) Date of Patent: Jan. 31, 2012

(54) LIQUID CRYSTAL DISPLAY AND DRIVING METHOD THEREOF

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 843 days.

(21) Appl. No.: 12/214,967

(22) Filed: Jun. 23, 2008

(65) Prior Publication Data

US 2008/0316162 A1 Dec. 25, 2008

(30) Foreign Application Priority Data

Jun. 22, 2007 (CN) ..... 2007 1 0076201

(51) Int. Cl.
*G09G 3/36* (2006.01)

(52) U.S. Cl. ..... 345/96; 345/99; 345/209

(58) Field of Classification Search ..... 345/96, 345/690, 100, 98, 94, 99, 209
See application file for complete search history.

(56) References Cited

U.S. PATENT DOCUMENTS

| | | | | |
|---|---|---|---|---|
| 5,438,342 | A * | 8/1995 | Yamaguchi | 345/58 |
| 6,222,516 | B1 * | 4/2001 | Oda et al. | 345/94 |
| 7,321,351 | B2 * | 1/2008 | Cheon | 345/89 |
| 2004/0130559 | A1 * | 7/2004 | Lee et al. | 345/690 |
| 2006/0244704 | A1 | 11/2006 | JaeHun | |
| 2007/0242024 | A1 * | 10/2007 | Sung | 345/100 |
| 2008/0024417 | A1 * | 1/2008 | Huang et al. | 345/98 |
| 2010/0289828 | A1 * | 11/2010 | Lee et al. | 345/690 |

FOREIGN PATENT DOCUMENTS

CN 1854823 A 11/2006

* cited by examiner

*Primary Examiner* — Amr Awad
*Assistant Examiner* — Bassam Noaman
(74) *Attorney, Agent, or Firm* — Altis Law Group, Inc.

(57) ABSTRACT

An exemplary liquid crystal display (300) includes a liquid crystal panel (301) receiving reference voltages; and a polarity resetting circuit (354) receiving display signals from external circuit and resetting the received display signals to attain resetted display signals, which makes the voltage difference between the resetted display signals and the previous frame display signals smaller than that between the corresponding received display signals and the previous frame display signals.

20 Claims, 3 Drawing Sheets

LIQUID CRYSTAL DISPLAY AND DRIVING METHOD THEREOF

CROSS-REFERENCE TO RELATED APPLICATION

This application is related to, and claims the benefit of, a foreign priority application filed in China as Serial No. 200710076201.X on Jun. 22, 2007. The related application is incorporated herein by reference.

FIELD OF THE INVENTION

The present invention relates to liquid crystal displays (LCDs), and more particularly to an LCD capable of compensating a common voltage signal thereof. The present invention also relates to a method for driving the LCD.

GENERAL BACKGROUND

LCDs are widely used in various information products, such as notebooks, personal digital assistants, video cameras, and the like.

FIG. 3 is essentially an abbreviated circuit diagram of a conventional LCD. The LCD 100 includes a liquid crystal panel 101, a gate driver 102, a source driver 103, a timing schedule controller 104 controlling the gate driver 102 and the source driver 103, and a common voltage circuit 105 for providing common voltage to the liquid crystal panel 101. The liquid crystal panel 101 includes n rows of parallel scanning lines 110 (where n is a natural number), n rows of parallel common lines 130 alternatively arranged with the scanning lines 110, m columns of parallel data lines 120 perpendicularly to the scanning lines 110 (where m is also a natural number), and a plurality of pixel units 140 cooperatively defined by the crossing scanning lines 110 and data lines 120. The scanning lines 110 are electrically coupled to the gate driver 102, and the data lines 120 are electrically coupled to the source driver 103. The common lines 130 are electrically coupled to the common voltage circuit 105.

Each pixel unit 140 includes a thin film transistor (TFT) 141, a pixel electrode 142, and a common electrode 143. A gate electrode of the TFT 141 is electrically coupled to a corresponding one of the scanning lines 110, and a source electrode of the TFT 141 is electrically coupled to a corresponding one of the data lines 120. Further, a drain electrode of the TFT 141 is electrically coupled to the pixel electrode 142. The common electrodes 143 of all the pixel units 140 are electrically coupled together and further electrically coupled to a common voltage generating circuit (not shown). In each pixel unit 140, liquid crystal molecules (not shown) are disposed between the pixel electrode 142 and the common electrode 143, so as to cooperatively form a liquid crystal capacitor 147. In addition, an insulator layer (not shown) is disposed between the pixel electrode 142 and the common line 130, so as to cooperatively form a storage capacitor 148.

In operation, the common electrodes 143 receive a common voltage signal from the common voltage generating circuit. The gate driver 102 provides a plurality of scanning signals to the scanning lines 110 sequentially, so as to activate the pixel units 140 row by row. The source driver 103 provides a plurality of data voltage signals to the pixel electrodes 142 of the activated pixel units 140. Thereby, the liquid crystal capacitors 147 and the storage capacitors 148 of the activated pixel units 140 are charged. After the charging process, an electric field is generated between the pixel electrode 142 and the common electrode 143 in each pixel unit 140. The electric field drives the liquid crystal molecules to control light transmission of the pixel unit 140, such that the pixel unit 140 displays a particular color (red, green, or blue) having a corresponding gray level. The electric field is maintained by the liquid crystal capacitor 147 during a so-called current frame period, and accordingly the gray level of the color is maintained during the current frame period.

In the LCD 100, each pixel unit 140 employs a capacitor structure (i.e. the liquid crystal capacitor 147 and the storage capacitor 148) to retain the gray level of the color. In addition, a plurality of parasitic capacitors usually exist in the pixel unit 140. Due to a so-called capacitor coupling effect, when the data voltage signal received by the pixel electrode 142 changes, an electrical potential of the common electrode 143 may be coupled and shift from the common voltage signal. Because the pixel units 140 are activated and receive the data voltage signals row by row, the electrical potentials of the common electrodes 143 of the activated row of pixel units 140 are liable to be pulled up or pulled down simultaneously and thereby have undesired values. Moreover, because the common electrodes 143 of the activated row of pixel units 140 are electrically coupled together, the undesired values of the electrical potentials are the same.

The shift of the electrical potential of the common electrode 143 may further bring on a change of the electric field between the pixel electrode 142 and the common electrode 143. Thereby, the gray level of the color displayed by the pixel unit 140 is apt to change, and accordingly a so-called color shift phenomenon may be generated. Thus the display quality of the LCD 100 may be somewhat unsatisfactory.

What is needed is to provide an LCD and a driving method thereof which can overcome the above-described deficiencies.

SUMMARY

In one aspect, an exemplary liquid crystal display includes a liquid crystal panel receiving reference voltages; and a polarity resetting circuit receiving display signals from external circuit and resetting the received display signals to attain resetted display signals, which makes the voltage difference between the resetted display signals and the previous frame display signals smaller than that between the corresponding received display signals and the previous frame display signals.

In another aspect, an exemplary method for driving a liquid crystal display, the method includes step a: receiving display signals from external circuit; step b: resetting the received display signals to attain resetted display signals, which makes the voltage difference between the resetted display signals and the previous frame display signals smaller than that between the corresponding received display signals and the previous frame display signals.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
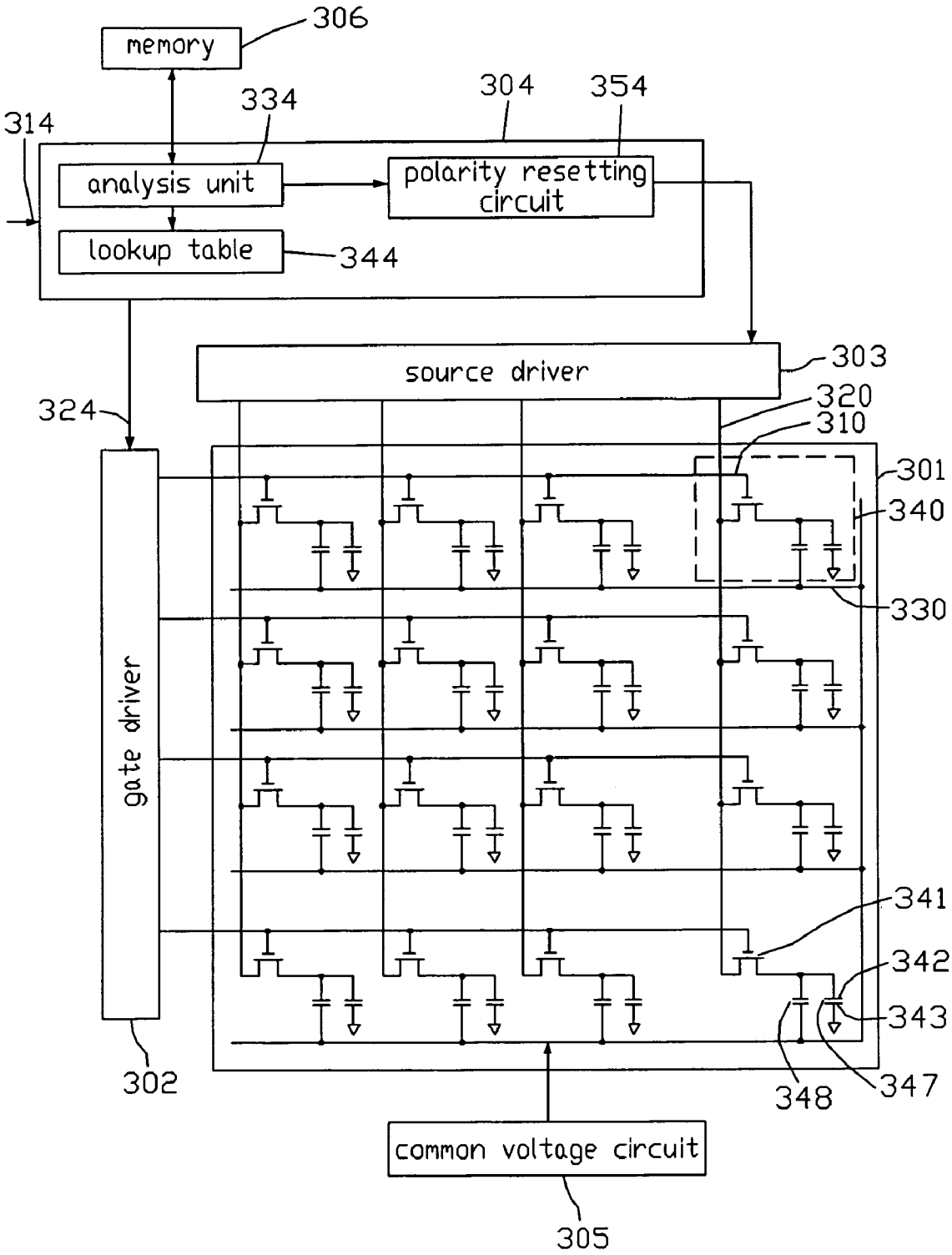
FIG. 1 is essentially an abbreviated circuit diagram of an LCD according to an exemplary embodiment of the present invention.

FIG. 1 is essentially an abbreviated circuit diagram of an LCD according to an exemplary embodiment of the present invention. The LCD 300 includes a liquid crystal panel 301, a gate driver 302, a source driver 303, a timing controller 304, a common voltage circuit 305, and a memory 306. The gate driver 302 and the source driver 303 are electrically connected to the timing controller 304, respectively providing scanning signals and data voltages corresponding to display signals to the liquid crystal panel 301. The common voltage circuit 305 is used to provide common voltage to the liquid crystal panel 301.

The liquid crystal panel 301 includes n rows of parallel scanning lines 310 (where n is a natural number), n rows of parallel common lines 330 alternately arranged with the scanning lines 310, m columns of parallel data lines 320 perpendicular to the scanning lines 310 and the common lines 330 (where m is also a natural number), and a plurality of pixel units 340 cooperatively defined by the crossing scanning lines 310 and data lines 320. The scanning lines 310 are electrically coupled to the gate driver 302. The data lines 320 are electrically coupled to the source driver 303. The common lines 330 are electrically coupled to the common voltage circuit 305. The pixel units 340 are arranged in a matrix.

Each pixel unit 340 includes a TFT 341, a pixel electrode 342, a common electrode 343, and a storage capacitor 348. A gate electrode of the TFT 341 is electrically coupled to a corresponding one of the scanning lines 310, and a source electrode of the TFT 341 is electrically coupled to a corresponding one of the data lines 320. Further, a drain electrode of the TFT 341 is electrically coupled to the pixel electrode 342. The common electrode 343 is opposite to the pixel electrode 342, with a plurality of the liquid crystal molecules (not shown) sandwiched therebetween, so as to cooperatively form a liquid crystal capacitor 347. One end of the storage capacitor 348 is electrically coupled to the pixel electrode 342, and the other end of the storage capacitor 348 is electrically coupled to a corresponding one of the common lines 330.

The timing controller 304 includes a first end 314, a second end 324, an analysis unit 334, a look up table (LUT) 344 and a polarity resetting circuit 354. The first end 314 is configured to receive display signals that are used for driving the pixel units 340. Each of the display signals corresponds to a respective pixel unit 340. In particular, each display signal is an 8-bit digital signal that corresponds to 256 gray levels. For example, if the 8-bit digital signal is 00000000, it corresponds to the first gray level indicating that a brightness of the corresponding color is lowest. If the 8-bit digital signal is 11111111, it corresponds to the 256th gray level indicating that a brightness of the corresponding color is greatest. The second end 324 is electrically coupled to the gate driver 302 for providing clock signals to the gate driver 302.

The LUT 344 is configured for storing a plurality of data voltages, each of which corresponds to a display signal. The memory 306 is configured to store two adjacent display signals. The analysis unit 334 is electrically connected to the memory 306, the lookup table 344, and the polarity resetting circuit 354. The analysis unit 334 is used to analyzing two data voltages corresponding to the two adjacent display signals, and providing the analyzing result and the two display signals to the polarity resetting circuit 354. After that, the polarity resetting circuit 354 resets the polarity of the data voltages of the display signals relative to the analyzing result, and outputs the resetted display signals to the source driver 303.

In typical operation, the pixel units 340 of the LCD 300 are driven row by row. To simplify the following description, only an operation of the Xth row of pixel units (X=1, 2, . . . , n) of the LCD 300 is taken as an example. In addition, the following definitions are used. Nth (N=2, 3, 4, . . . ) frame display signals $D_N$ refer to the display signals corresponding to the Xth row of pixel units 340 in a current frame period. Nth frame data voltages $U_N$ refer to the data voltages corresponding to the display signals the Xth row of pixel units 340 in a current frame period. (N−1)th frame display signals $D_N'$ refer to display signals corresponding to the Xth row of pixel units 340 in a previous frame period. (N−1)th frame data voltages $U_N'$ refer to the data voltages corresponding to the display signals the Xth row of pixel units 340 in a previous frame period. Nth frame polarity reversing data voltages $\overline{U_N}$ refer to the polarity reversed data voltages corresponding to the display signals the Xth row of pixel units 340 in a current frame period.

Figure 2:
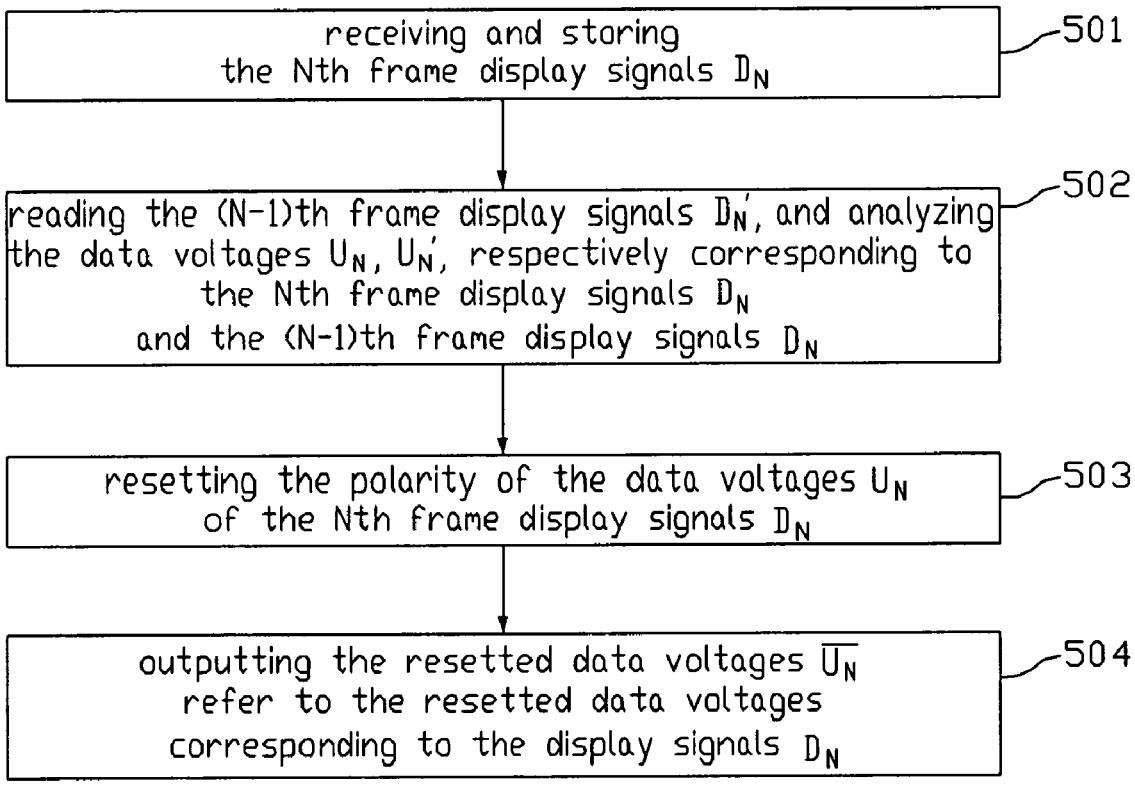
FIG. 2 is flow chart of an exemplary driving method for driving the LCD of FIG. 1, the driving method including steps 501~504.
Figure 3:
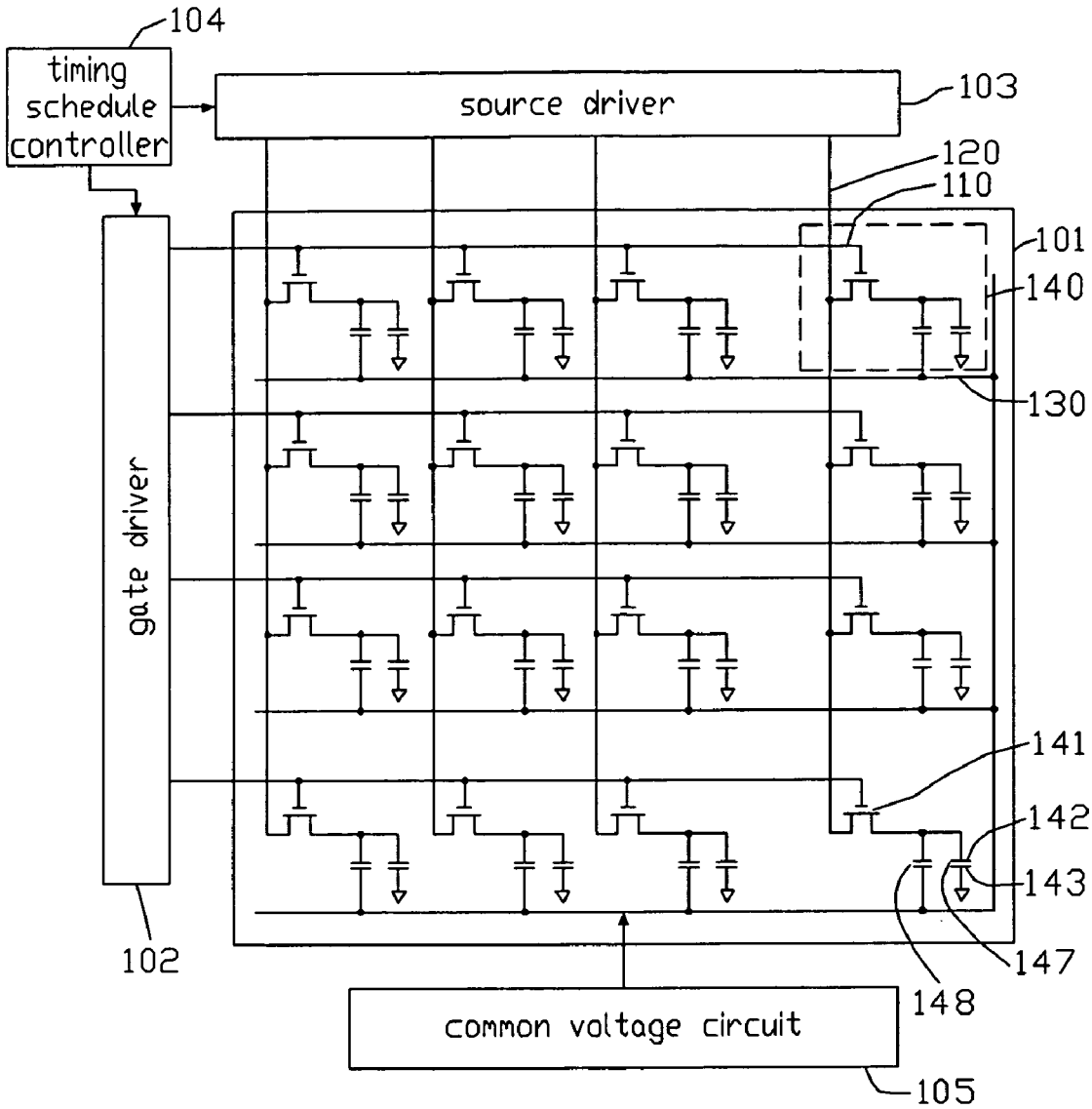
FIG. 3 (RELATED ART)
FIG. 3 is essentially an abbreviated circuit diagram of a conventional LCD.

The LCD 300 can be driven via a driving method summarized in FIG. 2. The driving method includes: step 501, receiving and storing the Nth frame display signals $D_N$; step 502, reading the (N−1)th frame display signals $D_N'$, and analyzing the data voltages $U_N$, $U_N'$, respectively corresponding to the Nth frame display signals $D_N$ and the (N−1)th frame display signals $D_N'$; step 503, resetting the polarity of the data voltages $U_N$ of the Nth frame display signals $D_N$; step 504; outputting the resetted data voltages $\overline{U_N}$ refer to the resetted data voltages corresponding to the display signals $D_N$.

In step 501, the Nth frame display signals $D_N$ are received from an external circuit (not shown) by the first end 314 of the timing controller 304. The Nth frame display signals $D_N$ are then stored in the memory 306, and are also outputted to the analysis unit 334.

In step 502, the (N−1)th frame display signals $D_{N-}1$ are read from the memory 306 by the timing controller 304. The analysis unit 334 reads the Nth frame data voltages $U_N$, and the (N−1)th frame data voltages $U_N'$, from the lookup table 344, respectively corresponding to the Nth frame display signals $D_N$ and the (N−1)th frame display signals $D_N'$. And then the analysis unit 334 subtracts each of the Nth frame data voltages $U_N$ from the corresponding one of the (N−1)th frame data voltages $U_N'$, whereby a plurality of subtraction values $\Delta U_N$ are obtained. After that, the analysis unit 334 reverses the polarities of each of the Nth frame data voltages $U_N$ according to the polarity of the common voltages of the common electrode 343, whereby a plurality of polarity reversing data voltages $\overline{U_N}$ are attained, and subtracts each of the Nth frame polarity reversing data voltages $\overline{U_N}$ from the corresponding one of the (N−1)th frame data voltages $U_N'$, whereby a plurality of polarity reversing subtraction values $\overline{\Delta U_N}$ are obtained. The analysis unit 334 further compares each of the plurality of subtraction values $\Delta U_N$ to the corresponding one of the polarity reversing subtraction values $\overline{\Delta U_N}$ to select a plurality of data voltages corresponding to the smaller subtraction values. For example, if the subtraction values $\Delta U_N$ is smaller than the polarity reversing subtraction values $\overline{\Delta U_N}$, the analysis unit 334 selects the data voltages $U_N$ as the output data voltage. If the polarity reversing subtraction values $\overline{\Delta U_N}$ is smaller than the subtraction values $\Delta U_N$, the analysis unit 334 selects the polarity reversing data voltages $\overline{\Delta U_N}$ as the output data voltage. Finally, the analysis unit 334 output the selected data voltages and their corresponding polarity signals to the polarity resetting circuit 354.

In step 503, the polarity resetting circuit 354 reset the Nth frame display signals $D_N$ according to the selected data voltages and their corresponding polarity signals for attaining a plurality of resetted Nth frame display signals $D_{NR}$, which corresponds to one smaller subtraction value between the Nth frame data voltages $U_N$ and the (N−1)th frame data voltages $U_N'$. The display signal generally is an 8-bit digital signal. The polarity resetting circuit 354 adds a polarity controlling bit after the 8-bit display signal, according to the corresponding polarity signal. That is, the polarity resetting circuit 354 produces a 9-bit digital signal to represent each display signals. For example, if one of the Nth frame display signals $D_N$ is 10101101, and the corresponding polarity signal is positive, the polarity resetting circuit 354 resets the Nth frame display signal $D_N$ 10101101 to 101011011, which represents the polarity of the resetted Nth frame display signal $D_{NR}$ being positive corresponding to the common voltage; if one of the Nth frame display signals $D_N$ is 10101101, and the corresponding polarity signal is negative, the polarity resetting circuit 354 resets the Nth frame display signal $D_N$ 10101101 to 101011010, which represents the polarity of the resetted Nth frame display signal $D_{NR}$ being negative corresponding to the common voltage. After that, the polarity resetting circuit 354 outputs the resetted Nth frame display signals $D_{NR}$ to the source driver 303.

In step 504, the scanning signals and the data voltage signals are respectively provided by the gate driver 302 and the source driver 303. In detail, the gate driver 302 receives a timing control signal from the timing control unit 304, and accordingly generates a plurality of scanning signals, one of which is used to activate the Xth row of pixel units 340. The source driver 303 receives the resetted Nth frame display signals $D_{NR}$ from the timing control unit 304, and accordingly generates a plurality of data voltage signals corresponding to the Xth row of pixel units 340.

The gate driver 302 outputs a corresponding one of the scanning signals to the Xth scanning line 310, so as to activate the Xth row of pixel units 340 via switching the corresponding TFTs 341 on. The source driver 303 outputs the data voltage signals to the activated pixel units 340 respectively via the data lines 320 and the corresponding TFTs 341. Thereby, the liquid crystal capacitors 347 in the activated row of pixel units 340 are charged. An electric field is generated between the pixel electrode 342 and the common electrode 343 in each pixel unit 340 after the charging process. The electric field drives the liquid crystal molecules of the pixel unit 340 to control the light transmission of the pixel unit 340, such that the pixel unit 340 displays a particular color (e.g., red, green, or blue) having a corresponding gray level.

After that, the following rows of pixel units 340 are activated and driven to display corresponding colors sequentially during the Nth frame period, and the driving process for each row is similar to that for the above-described Xth row of pixel units 340. The aggregation of colors displayed by all the pixel units 340 of the LCD 300 simultaneously constitutes an image viewed by a user of the LCD 300.

In the LCD 300, the polarity resetting circuit 354 resets the polarities corresponding to the data voltages of the display signals, which assures one smaller subtraction value between the Nth frame data voltages $U_N$ and the (N−1)th frame data voltages $U_N'$ after resetting process, for each pixel unit 340 of the LCD 300. Therefore, the LCD 300 has a smaller sum of subtraction values between two adjacent frame data voltages, of all pixel units 340, so as to compensate the common voltage signal $V_{com}$ that might otherwise be coupled and shift due to a capacitor coupling effect. Thus the electric field between the pixel electrode 342 and the common electrode 343 of each pixel unit 340 is stable during the current frame period. Accordingly, the gray level of the color displayed by the pixel unit 340 is also stable. Therefore any color shift phenomenon that might otherwise be induced because of the capacitor coupling effect is diminished or even eliminated, and the display quality of the LCD 300 is improved.

In alternative embodiments, the predetermined calculation can be carried out via software pre-programmed in the analysis unit 334. The analysis unit 334 and the polarity resetting circuit 354 can be integrated together. The memory 306 can further be integrated into the timing controller 304. The polarity controlling bit can be added at the beginning of each display signals.

It is to be further understood that even though numerous characteristics and advantages of preferred and exemplary embodiments have been set out in the foregoing description, together with details of structures and functions associated with the embodiments, the disclosure is illustrative only, and changes may be made in detail (including in matters of arrangement of parts) within the principles of the invention to the full extent indicated by the broad general meaning of the terms in which the appended claims are expressed.

What is claimed is:

1. A liquid crystal display, comprising:

a liquid crystal panel receiving reference voltages;

an analysis unit receiving current frame display signals, analyzing data voltages corresponding to the current frame display signals and data voltages corresponding to an adjacent frame display signals, comparing each data voltage corresponding to the current frame display signals with a corresponding one of the data voltages corresponding to the adjacent frame display signals to get a first subtraction result there between, polarity reversing the data voltages corresponding to the current frame display signals to get polarity reversing display signals, comparing each polarity reversing display signal to the corresponding one of the data voltages corresponding to the adjacent frame display signals to get a second subtraction result, and finally outputting a corresponding polarity controlling signal and selecting one of the polarity reversing display signals and the data voltages corresponding to the current frame display signals as output data voltages according to a smaller subtraction result between the first and the second subtraction results;

and a polarity resetting circuit electrically connected to the analysis unit, receiving the current frame display signals and resetting the current frame display signals according to the output data voltages and the corresponding polarity controlling signal to attain resetted display signals.

2. The liquid crystal display of claim 1, wherein the polarity resetting circuit changes the polarity of the current frame display signals according to the reference voltages, for resetting the current frame display signals.

3. The liquid crystal display of claim 2, wherein the polarity resetting circuit adds one polarity controlling bit to each of the current frame display signals for changing the polarities of the current frame display signals.

4. The liquid crystal display of claim 1, further comprising a timing controller, the analysis circuit and the polarity resetting circuit being integrated in the timing controller.

5. The liquid crystal display of claim 4, wherein the timing controller further comprises a lookup table, and the lookup table is configured for storing a plurality of data voltages each corresponding to a display signal, and is electrically connected to the analysis circuit for providing the corresponding data voltages of the current frame display signals to the analysis circuit.

6. The liquid crystal display of claim 1, further comprising a gate driver electrically connected to the timing controller and a plurality of gate lines of the liquid crystal panel, the gate driver receiving clock signals output from the timing controller to provide scanning signals to the liquid crystal panel.

7. The liquid crystal display of claim 1, further comprising a memory electrically connected to the analysis unit, which stores the current frame and the adjacent frame display signals.

8. The liquid crystal display of claim 1, further comprising a source driver electrically connected to the polarity resetting circuit, the source driver outputting data voltages corresponding to the resetted display signals from the polarity resetting circuit to the liquid crystal panel.

9. The liquid crystal display as claimed in claim 1, wherein voltage differences between the polarity reversing signals to the reference voltages are substantially equal to voltage differences between corresponding data voltages to the reference voltages.

10. The liquid crystal display as claimed in claim 9, wherein the reference voltage are common voltages.

11. The liquid crystal display as claimed in claim 1, wherein when the first subtraction result is less than the second subtraction result, the analysis unit generates data voltages corresponding to the current frame display signals as the output data voltages to the polarity resetting circuit.

12. The liquid crystal display as claimed in claim 11, wherein when the second subtraction result is less than the first subtraction result, the analysis unit generates data voltages corresponding to the polarity reversing display signals as the output data voltages to the polarity resetting circuit.

13. A method for driving a liquid crystal display, the method comprising:

step a: receiving display signals from an external circuit;

step b: reading current frame display signals and adjacent frame display signals and analyzing data voltages respectively corresponding to the current and the adjacent frame display signals, wherein in step b, an analysis unit comparing each data voltage corresponding to the current frame display signals with a corresponding one of the data voltages corresponding to the adjacent frame display signals to get a first subtraction result there between, polarity reversing the data voltages corresponding to the current frame display signals to get polarity reversing display signals, comparing each polarity reversing display signal to the corresponding one of the data voltages corresponding to the adjacent frame display signals to get a second subtraction result, and finally outputting a corresponding polarity controlling signal and selecting one of the polarity reversing display signals and the data voltages corresponding to the current frame display signals as output data voltages according to a smaller subtraction result between the first and the second subtraction results;

step c: resetting the current frame display signals according to the output data voltages and the corresponding polarity controlling signal to attain resetted display signals.

14. The method as claimed in claim 13, wherein, in the step a, further comprises a step of providing reference voltages from the external circuit to the liquid crystal display, and in the step c, the polarity of the current frame display signals is changed according to reference voltages, for resetting the received display signals.

15. The method as claimed in claim 14, wherein, in the step c, one polarity controlling bit to each of the current frame display signals for changing the polarities of the current frame display signals is added.

16. The method as claimed in claim 14, wherein a memory is provided to store the current and the adjacent frame display signals.

17. The method as claimed in claim 14, wherein voltage differences between the polarity reversing signals to the reference voltages are substantially equal to voltage differences between corresponding data voltages to the reference voltages.

18. The method as claimed in claim 17, wherein the reference voltages are common voltages.

19. The method as claimed in claim 13, wherein when the first subtraction result is less than the second subtraction result, the analysis unit generates data voltages corresponding to the current frame display signals as the output data voltages to the polarity resetting circuit.

20. The method as claimed in claim 19, wherein when the second subtraction result is less than the first subtraction result, the analysis unit generates data voltages corresponding to the polarity reversing display signals as the output data voltages to the polarity resetting circuit.

* * * * *